US009279545B2

(12) United States Patent
Lin

(10) Patent No.: US 9,279,545 B2
(45) Date of Patent: Mar. 8, 2016

(54) HIGH HEAT DISSIPATION LAMP

(71) Applicant: Genius Electronic Optical Co., Ltd., Taichung (TW)

(72) Inventor: Chih-Shen Lin, Taichung (TW)

(73) Assignee: GENIUS ELECTRONIC OPTICAL CO., LTD. (TW)

( * ) Notice: Subject to any disclaimer, the term of this patent is extended or adjusted under 35 U.S.C. 154(b) by 0 days.

(21) Appl. No.: 14/315,413

(22) Filed: Jun. 26, 2014

(65) Prior Publication Data

US 2015/0003057 A1 Jan. 1, 2015

(30) Foreign Application Priority Data

Jun. 27, 2013 (TW) ..... 102122875 A
Mar. 27, 2014 (TW) ..... 103111397 A

(51) Int. Cl.

| | |
|---|---|
| ***F21V 29/00*** | (2015.01) |
| ***F21V 21/00*** | (2006.01) |
| ***F21S 4/00*** | (2006.01) |
| ***F21K 99/00*** | (2010.01) |

(52) U.S. Cl.
CPC . *F21K 9/30* (2013.01); *F21V 29/30* (2013.01); *F21K 9/54* (2013.01)

(58) Field of Classification Search
CPC ..... F21K 9/30; F21K 9/54; F21V 29/30; H01L 33/64
See application file for complete search history.

(56) References Cited

U.S. PATENT DOCUMENTS

| | | | | |
|---|---|---|---|---|
| 2012/0057351 | A1* | 3/2012 | Wilcox et al. | 362/307 |
| 2012/0063116 | A1* | 3/2012 | Baxter et al. | 362/6 |
| 2012/0155094 | A1* | 6/2012 | DeRose | F21V 29/30 362/373 |
| 2014/0247597 | A1* | 9/2014 | Abe et al. | 362/249.06 |

FOREIGN PATENT DOCUMENTS

| | | | | |
|---|---|---|---|---|
| JP | 3158033 | U | 3/2010 | |
| JP | 2011187264 | A | 9/2011 | |
| TW | M404324 | U1 | 5/2011 | |
| WO | WO 2014017005 | A1 * | 1/2014 | F21V 29/00 |

OTHER PUBLICATIONS

Office Action of corresponding JP application, published on Feb. 5, 2015.

* cited by examiner

*Primary Examiner* — Donald Raleigh
(74) *Attorney, Agent, or Firm* — Baker & McKenzie LLP

(57) ABSTRACT

A high heat dissipation lamp includes a base, a lower cover, and a substrate. The base is a hollow structure, inside the base is defined a first hole. The lower cover is a hollow structure aligned with the base, and inside the lower cover is defined a second hole. The substrate is clamped between the base and the lower cover, and has a first surface located toward the first hole and a second surface located toward the second hole. On the first surface are provided a plurality of light emitting diodes. The first and second surfaces of the substrate come into direct contact with the base and the first and second holes of the lower cover, so as to improve thermal convection performance. Besides, the base and the lower cover of the lamp are annular-shaped, which makes the lamp easy to manufacture while having a strengthen structure.

9 Claims, 5 Drawing Sheets

HIGH HEAT DISSIPATION LAMP

CROSS REFERENCE TO RELATED APPLICATIONS

This application claims the benefit of priority to TW 102122875, filed on Jun. 27, 2013, and to TW 103111397, filed on Mar. 27, 2014, both with the Intellectual Property Office of the Republic of China, Taiwan, the specifications of which are incorporated herein in their entirety by reference.

BACKGROUND OF THE INVENTION

1. Field of the Invention

The present invention relates to a lamp, and more particularly to a high heat dissipation lamp.

2. Description of the Prior Art

LED has been widely used in various illumination applications, and for high power lamps, such as fish attracting lamp, stadium lamp, stage lamp, mill lamp and etc. High power lamp, when powered on, will produce a lot of heat energy, which is likely to burn the shell of the lamp or the lamp holder, or even burn the LED itself. The poor heat dissipation performance greatly limits the application of the conventional LED lamps. Some of the LED lamps are equipped with heat dissipation modules; however, the installation of the heat dissipation module is complicated and adversely affects the manufacturing capacity.

To solve the heat dissipation problem, TW Patent No. M404324 discloses "LED lamp", which comprises a base for connecting to a power supply, a metal funnel-shaped lamp housing coaxially disposed on base, a LED module disposed on the top of the lamp housing, and a lamp shade. On the outer surface of the lamp housing is formed a plurality of ribs. The LED module includes a substrate and a plurality of light emitting diodes disposed on the substrate. Grooves defined between neighboring ribs facilitate air convection, and therefore improve heat dissipation efficiency.

However, the LED lamp housing is difficult to manufacture, and not suitable for mass production. Besides, the ribs are only formed at two ends of the lamp housing, which enhances structure strength but makes the lamp inconvenient to use.

The present invention has arisen to mitigate and/or obviate the afore-described disadvantages.

SUMMARY OF THE INVENTION

The primary objective of the present invention is to provide a high heat dissipation lamp, which is strengthened in structure and easy to manufacture.

To achieve the above objective, a high heat dissipation lamp in accordance with the present invention comprises: a hollow base defining a first hole; a hollow lower cover aligned with the base and defining a second hole; and a substrate clamped between the base and the lower cover, and having a first surface located toward the first hole and a second surface located toward the second hole, wherein the substrate is provided a plurality of light emitting diodes on the first surface.

The advantage of the present invention is that the substrate has two surfaces coming into direct contact with the base and the first and second holes of the lower cover, so as to improve thermal convection performance. Besides, the base and the lower cover of the lamp are annular-shaped, so that the lamp is easy to manufacture while having a strengthen structure.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
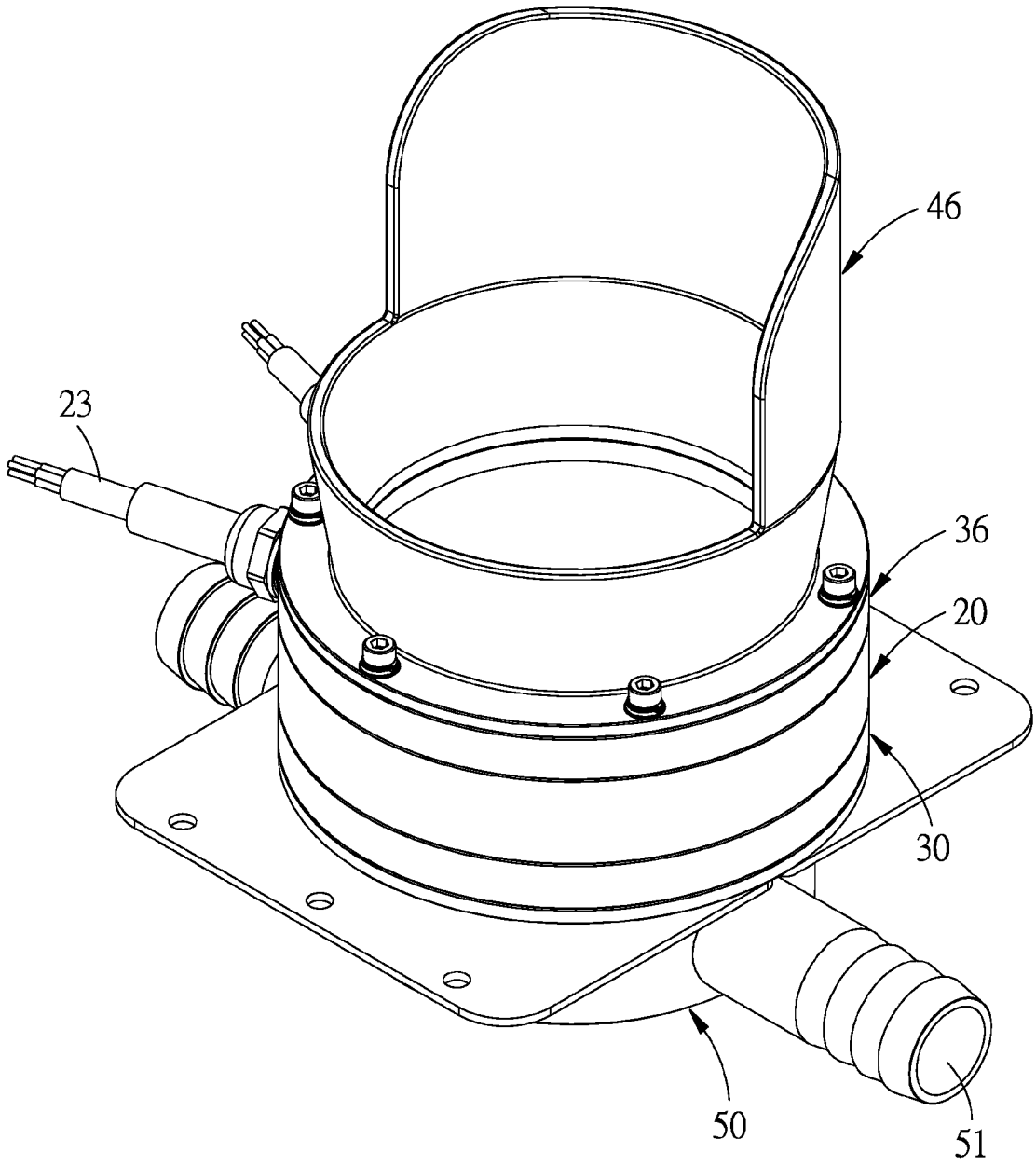
FIG. 1 is a perspective view of a high heat dissipation lamp in accordance with a first embodiment of the present invention.
Figure 2:
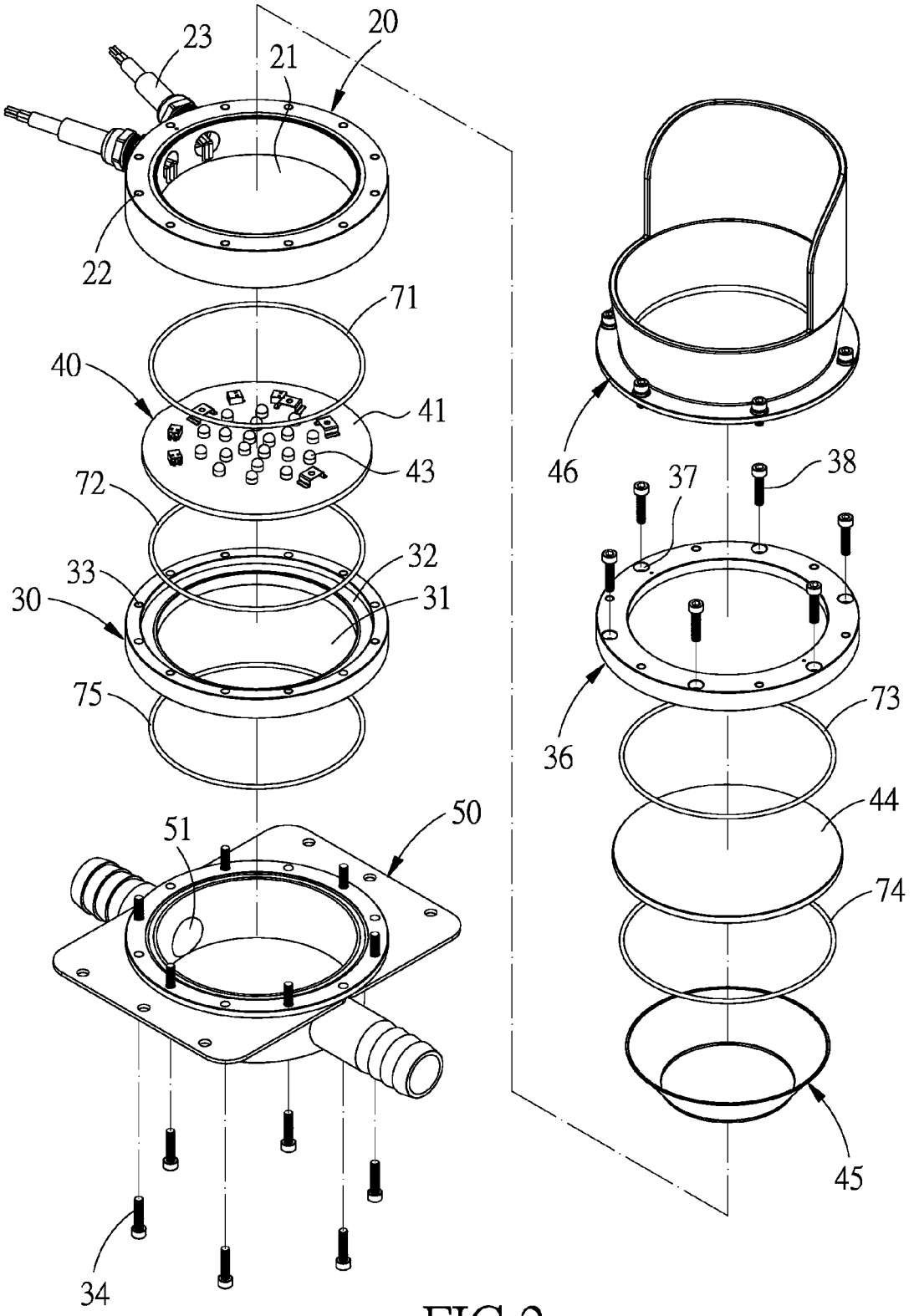
FIG. 2 is an exploded view of the high heat dissipation lamp in accordance with the first embodiment of the present invention.
Figure 3:
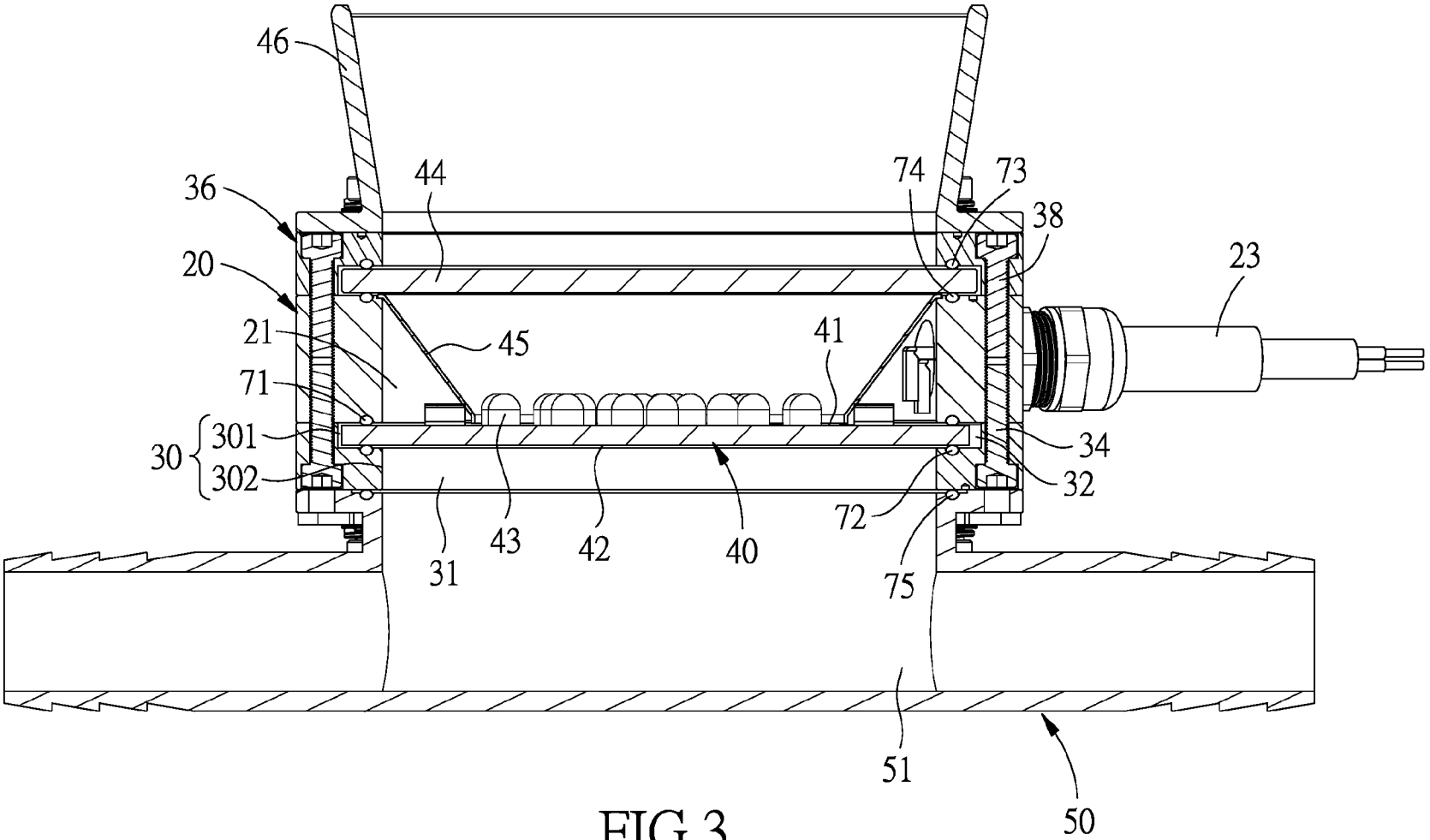
FIG. 3 is a cross sectional view of the high heat dissipation lamp in accordance with the first embodiment of the present invention.

Referring to FIGS. 1-3, a high heat dissipation lamp in accordance with a first preferred embodiment of the present invention comprises: a base 20, a lower cover 30, a substrate 40, an upper cover 36, a light transmitting member 44, an inner reflection cup 45, a heat transmitting pipe 50, and an outer reflection cup 46.

The base 20 is a hollow structure formed with a plurality of threaded holes 22, inside the base 20 is defined a first hole 21, and on the outer surface of the base 20 is provided an electric connection portion 23 for connecting to a power supply.

The lower cover 30 is a hollow structure aligned with and fixed to the base 20, and inside the lower cover 30 is defined a second hole 31. In this embodiment, the second hole 31 includes a first section 301 and a second section 302 which is smaller in diameter than the first section 301, and the first section 301 is located between the second section 302 and the base 20, so that the first section 301, the second section 302 and the base 20 define a groove 32. The lower cover 30 is formed with a plurality of lower holes 33 aligned with the threaded holes 22 of the base 20, and a plurality of bolts 34 are inserted through the lower holes 33 and screwed in the threaded holes 22. The lower holes 33 can be countersunk holes for accommodation of the heads of the bolts 34.

The substrate 40 is clamped between the base 20 and the lower cover 30, and two O-rings 71, 72 are disposed between the substrate 40 and the base 20 and between the substrate 40 and the lower cover 30, respectively, to provide a sealing effect. The substrate 40 has a first surface 41 located toward the first hole 21 and a second surface 42 located toward the second hole 31, and on the first surface 41 is provided a plurality of light emitting diodes 43. In this embodiment, the substrate 40 is disposed in the groove 32 and can be a ceramic substrate, a metal substrate, a semiconductor substrate or a composite substrate.

The upper cover 36 is fixed to the base 20, and the base 20 is located between the upper and lower covers 36, 30. The upper cover 36 is provided with a plurality of upper holes 37 aligned with the threaded holes 22 of the base 20, and then a plurality of bolts 38 are inserted through the upper holes 37 and screwed in the threaded holes 22. The upper holes 37 can be countersunk holes for accommodation of the heads of the bolts 38.

The light transmitting member 44 is clamped between the upper cover 36 and the base 20, and two O-rings 73, 74 are disposed between the light transmitting member 44 and the base 20 and between the light transmitting member 44 and the upper cover 36, respectively, to provide a sealing effect. The light transmitting member 44 protects the first surface 41 of the substrate 40, and allows passage of the light emitted from the light emitting diodes 43.

The inner reflection cup 45 is clamped between the light transmitting member 44 and the substrate 40, disposed in the first hole 21, and used to focus the light generated from the light emitting diodes 43 which are disposed on the substrate 40.

The heat transmitting pipe 50 is fixed to the lower cover 30, and an O-ring 75 is disposed between the heat transmitting pipe 50 and the lower cover 30 to provide a sealing effect. Inside the heat transmitting pipe 50 is a liquid-flow passage 51 in communication with the second hole 31, and coolant can flow through the liquid-flow passage 51 to improve heat dissipate efficiency.

The outer reflection cup 46 is disposed on the upper cover 36 to allow the user to change the light emitting direction of the light beams generated from the light emitting diodes 43.

What mentioned above are the structures of the first preferred embodiment of the present invention, for a better understanding of a high heat dissipation lamp of the invention, its operating advantages and the specific objects attained by its uses, reference should be had to FIGS. 1-3 again. The substrate 40 is disposed between the base 20 and the lower cover 30, and has the first and second surfaces 41, 42 coming into direct contact with the first hole 21 of the base 20, and the second hole 31 of the lower cover 30, respectively, which improves the thermal convection of the substrate 40.

The components of the high heat dissipation lamp of the present invention can be selectively used as desired by the user. For example, if the user wants an improved light concentration or wants to change the light beam direction, he/she can put the inner reflection cup 45 between the light transmitting member 44 and the substrate 40 to collect or concentrate the light, or can put the outer reflection cup 46 onto the upper cover 36 to change the direction of the light.

To improve heat dissipation efficiency, the user can install the heat transmitting pipe 50 which is communication with the second hole 31 to the lower cover 30, so that the coolant inside the liquid-flow passage 51 comes into direct contact with the second surface 42 of the substrate 40.

Figure 4:
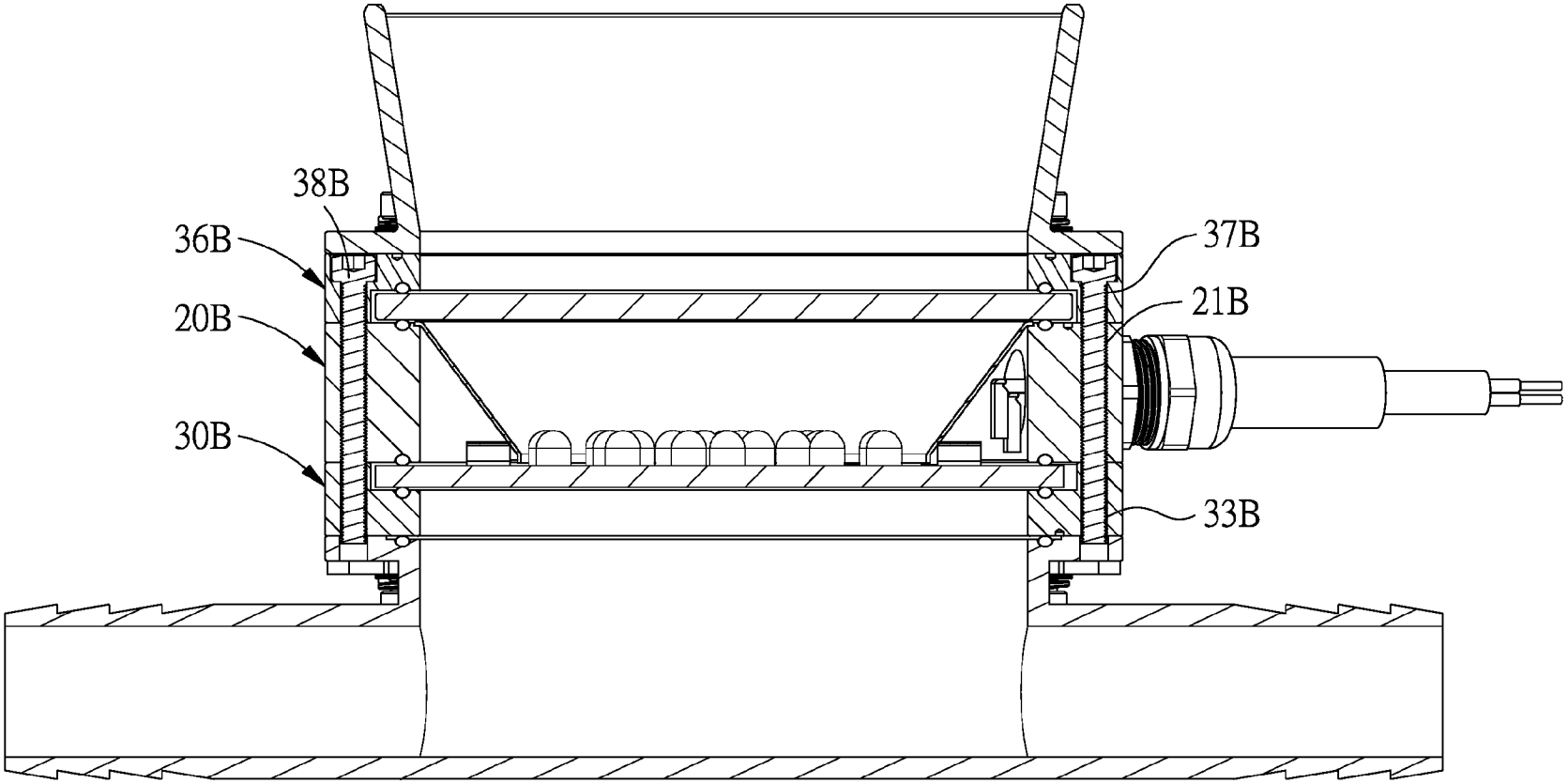
FIG. 4 is a cross sectional view of a high heat dissipation lamp in accordance with a second embodiment of the present invention.

Referring to FIG. 4, a high heat dissipation lamp in accordance with a second preferred embodiment of the present invention is similar to the first embodiment, except that: the upper cover 36B is provided with a plurality of upper holes 37B, the base 20B includes a plurality of middle holes 21B, the lower cover 30B is formed with a plurality of threaded holes 33B which are aligned with the upper holes 37B and the middle holes 21B, then a plurality of bolts 38B are inserted through the upper holes 37B and the middle holes 21B and screwed in the threaded holes 33B. The assembly of the high heat dissipation lamp of the second embodiment only requires the insertion of the bolts 38B from one side, which saves assembly time. The upper holes 37B are countersunk holes.

Figure 5:
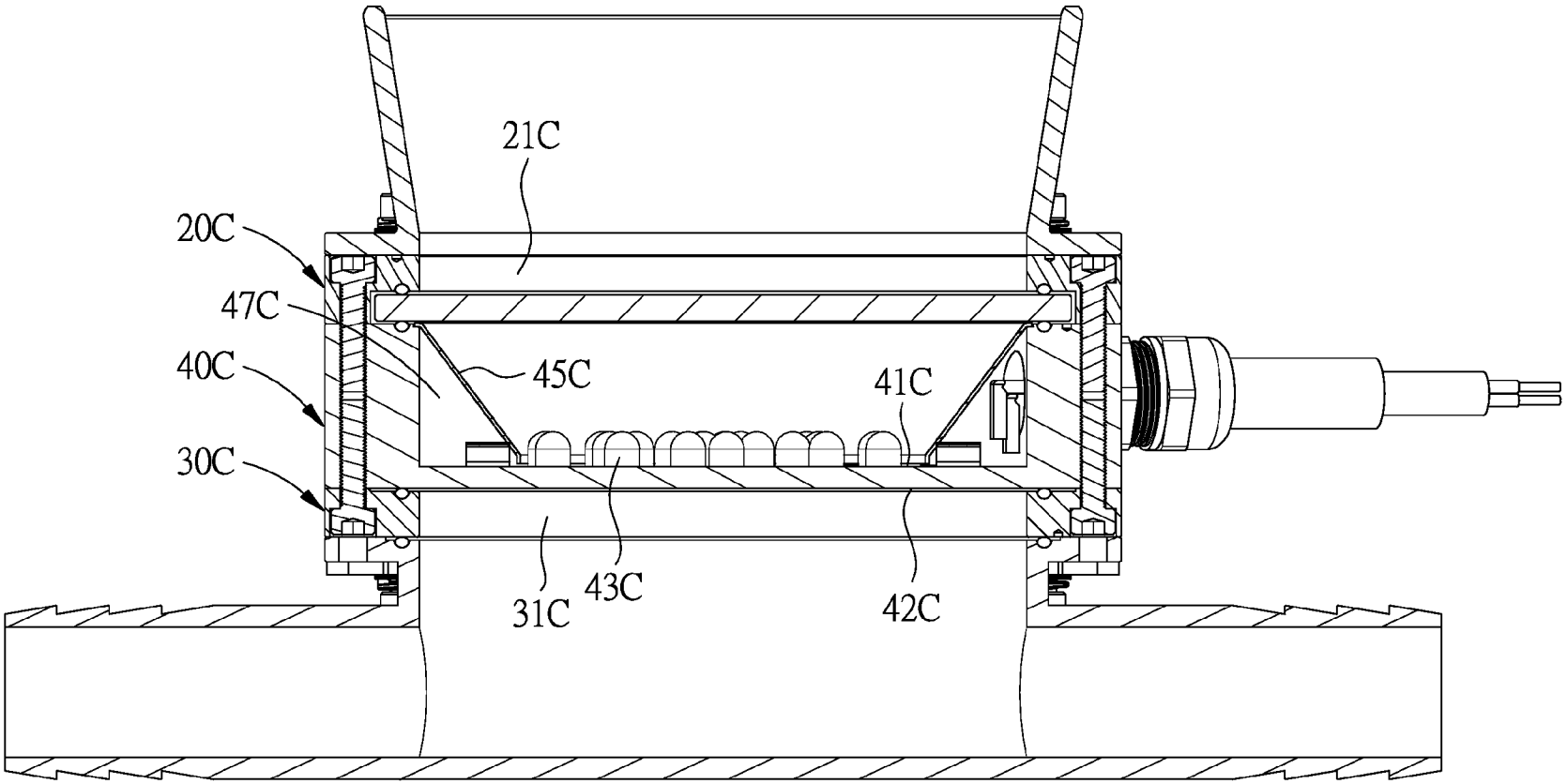
FIG. 5 is a cross sectional view of a high heat dissipation lamp in accordance with a third embodiment of the present invention.

Referring to FIG. 5, a high heat dissipation lamp in accordance with a third preferred embodiment of the present invention comprises: a base 20C, a lower cover 30C and a substrate 40C. The base 20C is annular-shaped and has a first hole 21C, and the lower cover 30C is a hollow structure with a second hole 31C and aligned with the base 20C. The substrate 40C is clamped between the base 20C and the lower cover 30C, and has a first surface 41C located toward the first hole 21C and a second surface 42C located toward the second hole 31C. The first surface 41C of the substrate 40C is formed with a groove 47C for holding the light emitting diodes 43C and the inner reflection cup 45C.

While we have shown and described various embodiments in accordance with the present invention, it is clear to those skilled in the art that further embodiments may be made without departing from the scope of the present invention.

What is claimed is:

1. A high heat dissipation lamp comprising:

a hollow base defining a first hole;

a hollow lower cover aligned with the base and defining a second hole;

a substrate clamped between the base and the lower cover, and having a first surface located toward the first hole and a second surface located toward the second hole, wherein the substrate is provided a plurality of light emitting diodes on the first surface; and a heat transmitting pipe having a liquid-flow passage in communication with the second hole for a coolant flowing through and directly contacting the second surface of the substrate to increase heat dissipation efficiency.

2. The high heat dissipation lamp as claimed in claim 1, wherein the second hole includes a first section and a second section which is smaller in diameter than the first section, the first section is located between the second section and the base, and the first section, the second section and the base define a groove for holding the substrate.

3. The high heat dissipation lamp as claimed in claim 1 further comprising an upper cover and a light transmitting member, wherein the upper cover is fixed to the base, the base is located between the upper and lower covers, and the light transmitting member is clamped between the upper cover and the base.

4. The high heat dissipation lamp as claimed in claim 3 further comprising an inner reflection cup which is clamped between the light transmitting member and the substrate and disposed in the first hole.

5. The high heat dissipation lamp as claimed in claim 3, wherein the base is formed with a plurality of threaded holes, the upper cover is provided with a plurality of upper holes aligned with the threaded holes of the base, the lower cover is formed with a plurality of lower holes aligned with the threaded holes of the base, a plurality of bolts are inserted through the lower holes and screwed in the threaded holes, and another plurality of bolts are inserted through the upper holes and screwed in the threaded holes.

6. The high heat dissipation lamp as claimed in claim 5, wherein the upper and lower holes are countersunk holes.

7. The high heat dissipation lamp as claimed in claim 3, wherein the upper cover is provided with a plurality of upper holes, the base includes a plurality of middle holes, the lower cover is formed with a plurality of threaded holes which are aligned with the upper holes and the middle holes, and a plurality of bolts are inserted through the upper holes and the middle holes and screwed in the threaded holes.

8. The high heat dissipation lamp as claimed in claim 3 further comprising an outer reflection cup disposed on the upper cover.

9. The high heat dissipation lamp as claimed in claim 1, wherein the base has a groove formed on the first surface of the substrate for holding the light emitting diodes.

* * * * *